US006183851B1

(12) United States Patent
Mishima

(10) Patent No.: US 6,183,851 B1
(45) Date of Patent: Feb. 6, 2001

(54) INK JET IMAGE RECORDING MEDIUM

(75) Inventor: Masayuki Mishima, Minami Ashigara (JP)

(73) Assignee: Fuji Photo Film Co., Ltd., Kanagawa (JP)

( * ) Notice: Under 35 U.S.C. 154(b), the term of this patent shall be extended for 0 days.

(21) Appl. No.: 09/092,947

(22) Filed: Jun. 8, 1998

(30) Foreign Application Priority Data

Jun. 9, 1997 (JP) ..... 9-151044

(51) Int. Cl.[7] ..... B41M 5/00

(52) U.S. Cl. ..... 428/304.4; 428/195; 428/328; 428/329; 428/331

(58) Field of Search ..... 428/195, 328, 428/329, 331, 304.4

(56) References Cited

FOREIGN PATENT DOCUMENTS

| | | | |
|---|---|---|---|
| 6-064306 | | 3/1994 | (JP) . |
| 6-183134 | | 7/1994 | (JP) . |
| 761147 | * | 3/1995 | (JP) . |
| 8230309 | * | 9/1996 | (JP) . |
| 8244336 | * | 9/1996 | (JP) . |

* cited by examiner

*Primary Examiner*—Bruce H. Hess
(74) *Attorney, Agent, or Firm*—Birch, Stewart, Kolasch & Birch LLP

(57) ABSTRACT

The present invention provides an image recording medium which can dry an ink at a high rate, gives an excellent image quality and exhibits an excellent light-fastness. A novel ink jet image recording medium is provided comprising a coating layer provided on a support, wherein said coating layer comprises a dye-receptive polymer comprising a monomer unit represented by the following general formula (I) and one or more inorganic pigments incorporated therein:

(I)

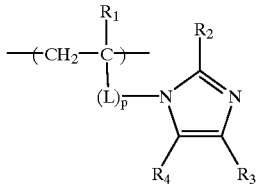

wherein $R_1$, $R_2$, $R_3$ and $R_4$ each independently represent a hydrogen atom or an alkyl group which may be straight-chain or branched; L represents a divalent connecting group; and p represents an integer of 0 or 1.

12 Claims, No Drawings

INK JET IMAGE RECORDING MEDIUM

FIELD OF THE INVENTION

The present invention relates to an ink jet image recording medium which gives an excellent image quality and exhibits an excellent light-fastness.

BACKGROUND OF THE INVENTION

With the spread of personal computers, printers such as ink jet printers have rapidly spread. Further, with the spread of photo scanners, photo CDs and digital cameras, the demand for printing system for printing digitized photographic image has been rapidly growing. In particular, the spread of simple inexpensive ink jet printers is remarkable. For these ink jet printers, the demand for better image quality has been growing year by year.

As a recording medium for use in ink jet recording system, there has heretofore been used an ordinary paper or a recording medium comprising an ink-receptive layer provided on a support which is called ink jet recording paper. However, an ink can easily run on such a recording medium. Further, such a recording medium exhibits a low gloss. Thus, such a recording medium cannot be put into practical use in the field of photographic image where a high resolution and gloss are required.

As an approach for solving these problems, a technique for ink jet recording medium using a paper coated with a resin on both sides thereof (i.e., so-called RC (resin-coated) paper) as a support and using gelatin as an ink-receptive layer is disclosed in JP-A-4-216990 and JP-A-6-64306 (The term "JP-A" as used herein means an "unexamined published Japanese patent application").

As an approach for bringing the appearance and touch of an image output from ink jet printers close to that of conventional photographic image, a recording medium comprising a synthetic hydrophilic resin in an ink-receptive layer and an ink jet recording method using the same are disclosed in JP-A-7-179032.

As an approach for improving the quality and stability of an image output from ink jet printers, a method involving the use of an image recording medium comprising an ink-receptive layer containing gelatin and a basic latex provided on a resin-coated support is disclosed in JP-A-8-244336.

It is certain that the foregoing proposals can give an image having a gloss closer to that of photographic image than with the conventional ink jet recording paper. However, the recording media proposed dry an ink at a low rate. Thus, an image formed on these recording media was not satisfactory in respect to resolution or graininess. For example, the image formed on these recording media shows stain or beading (granular density unevenness) that deteriorates image quality. In particular, a picture having a relatively small area printed on these recording media using a high speed printer shows a deteriorated image quality. Further, when these recording media are used for a printer of the type involving the jetting of a plurality of ink droplets having a low concentration for better image quality, the image thus formed is blurred. Moreover, the image thus formed can be transferred to other papers or objects which are superimposed thereon.

For the purpose of solving these problems, many recording media which can dry an ink at a high rate have been disclosed. For example, JP-A-8-230309 and JP-A-6-183134 disclose a recording medium comprising a silica pigment. For example, JP-A-3-281383, JP-A-4-267180 and JP-A-5-24335 disclose a recording medium comprising an alumina pigment. These recording media comprise a porous recording layer which can fairly absorb an ink and hence dry at a raised rate. However, these recording media are disadvantageous in that since it is arranged to absorb an ink by an inorganic pigment such as silica pigment and alumina pigment, it exhibits a drastically deteriorated light-fastness. It has thus been keenly desired to provide a recording medium which can dry an ink at a high rate, gives an excellent image quality and exhibits an excellent light-fastness.

SUMMARY OF THE INVENTION

It is therefore an object of the present invention to provide an image recording medium which can dry an ink at a higher rate than ever, gives an excellent image quality and exhibits an excellent light-fastness.

It is another object of the present invention to provide an image recording medium which can give a high image quality and exhibit a high light-fastness with a printer for printing digital image data, e.g., by ink jet printing process, particularly an ink jet printer which exhibits improved performances and hence a raised printing rate or an ink jet printer which jets a plurality of ink droplets having a low concentration to give an improved image quality.

These and other objects of the present invention will become more apparent from the following detailed description and examples.

The foregoing objects of the present invention are accomplished with the followings:

(1) An ink jet image recording medium comprising a coating layer provided on a support, wherein said coating layer comprises a dye-receptive polymer comprising a monomer unit represented by the following general formula (I) and one or more inorganic pigments incorporated therein:

(I)

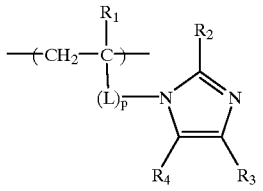

wherein $R_1$, $R_2$, $R_3$ and $R_4$ each independently represent a hydrogen atom or an alkyl group which may be straight-chain or branched; L represents a divalent connecting group; and p represents an integer of 0 or 1.

(2) The ink jet image recording medium as defined in Clause (1), wherein at least one of said inorganic pigments is an alumina pigment.

(3) The ink jet image recording medium as defined in Clause (1) or (2), wherein said alumina pigment is an anhydrous alumina pigment.

(4) The ink jet image recording medium as defined in Clause (1) or (2), wherein said alumina pigment is alumina hydrate.

(5) The ink jet image recording medium as defined in any one of Clauses (1), (2) and (4), wherein said alumina hydrate is pseudoboehmite.

(6) The ink jet image recording medium as defined in Clause (1), wherein at least one of said inorganic pigments is a silica pigment.

(7) The ink jet image recording medium as defined in any one of Clauses (1) to (6), wherein said coating layer consists of two or more layers, the upper layer containing a dye-receptive polymer comprising a monomer unit represented by the general formula (I) and the lower containing one or more inorganic pigments.

(8) The ink jet image recording medium as defined in any one of Clauses (1) to (3), wherein said coating layer consists of two or more layers, the upper layer containing one or more inorganic pigments and the lower containing a dye-receptive polymer comprising a monomer unit represented by the general formula (I).

In the present invention, the combined use of a dye-receptive polymer comprising a monomer unit represented by the general formula (I) and one or more inorganic pigments exerts a synergistic effect for enhancing the ink absorption rate and the dye receptivity to an extent that cannot be expected with the single use of these components, making it possible to provide an image recording medium which gives a very excellent image quality and exhibits an excellent light-fastness.

DETAILED DESCRIPTION OF THE INVENTION

The present invention will be further described hereinafter.

In the dye-receptive polymer comprising a monomer unit represented by the general formula (I) of the present invention, $R_1$, $R_2$, $R_3$ and $R_4$ each independently represent a hydrogen atom or a lower alkyl group (preferably $C_{1-10}$ alkyl groups such as a methyl group, an ethyl group, an n-propyl group, an n-butyl group, an n-amyl group and an n-hexyl group), more preferably, a hydrogen atom, a methyl group or an ethyl group.

L represents a divalent connecting group having 1 to about 20 carbon atoms, preferably 1 to 10 carbon atoms, such as an alkylene group, a phenylene group and an arylene group. Specific preferred examples of these divalent groups will be given below.

(1)

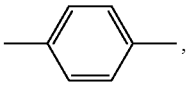

(2)

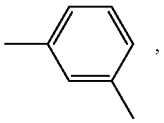

(3)

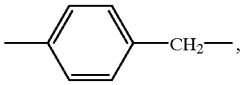

(4)

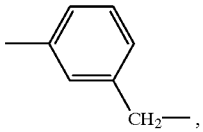

(5)

$—CO_2—$ ,

-continued (6)

—CONH— , (7)

$—CO_2—CH_2CH_2—$ , (8)

$—CO_2—CH_2CH_2CH_2—$ , (9)

$—CONHCH_2—$ , (10)

$—CONHCH_2CH_2—$ , (11)

$—CONHCH_2CH_2CH_2—$ ,

Specific preferred examples of the monomer unit represented by the general formula (I) which constitutes the dye-receptive polymer of the present invention will be given, but the present invention should not be construed as being limited thereto.

(1)

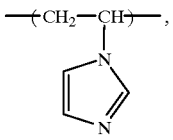

(2)

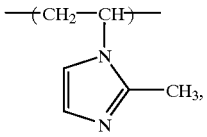

(3)

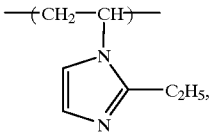

(4)

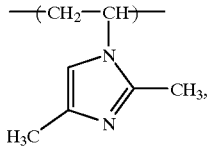

(5)

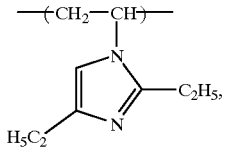

(6)

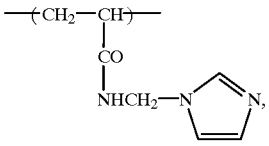

-continued (7)

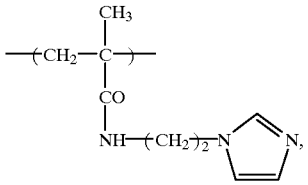

(8)

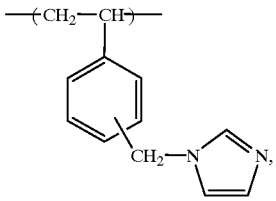

(9)

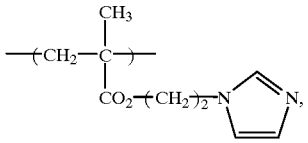

The dye-receptive polymer employable herein may contain monomer units other than the monomer unit represented by the general formula (I). Preferred examples of these monomer units include pyrrolidones, acrylic acid esters (e.g., n-butyl acrylate), methacrylic acid esters (e.g., n-butyl methacrylate), acrylamides (e.g., diacetone acrylamide), methacrylamides (e.g., n-butyl methacrylamide), and styrenes (e.g., styrenesulfic acid). The dye-receptive polymer employable herein may further contain comonomers described in JP-A-59-169042 and JP-A-62-244036. Two or more of these monomer units may be used. The weight average molecular weight of the dye-receptive polymer employable herein is preferably from $5\times10^3$ to $1\times10^7$ (degree of polymerization: about 20 to about 100,000). If the molecular weight of the dye-receptive polymer employable herein is too small, the polymer can migrate too easily. On the contrary, if the molecular weight of the dye-receptive polymer employable herein is too great, the polymer may hardly be applied.

Specific preferred examples of the dye-receptive polymer employable herein will be given below, but the present invention should not be construed as being limited thereto. Two or more of these dye-receptive polymers may be used in combination.

P-1

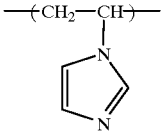

P-2

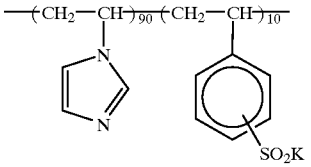

-continued

P-3

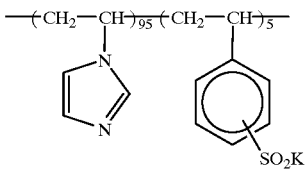

P-4

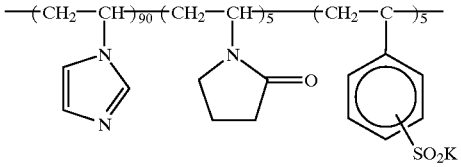

P-5

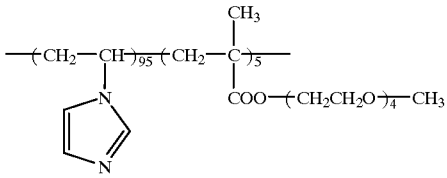

P-6

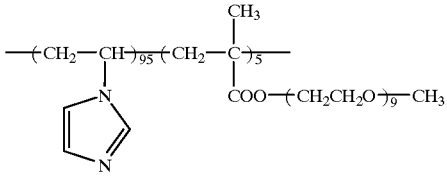

P-7

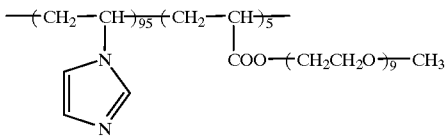

P-8

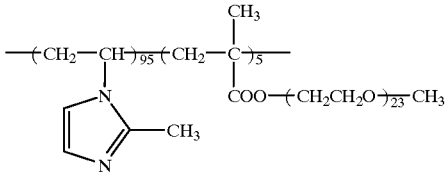

P-9

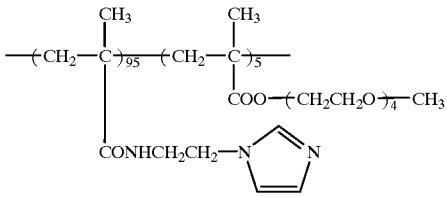

P-10

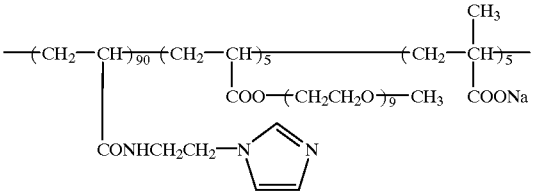

-continued

P-11

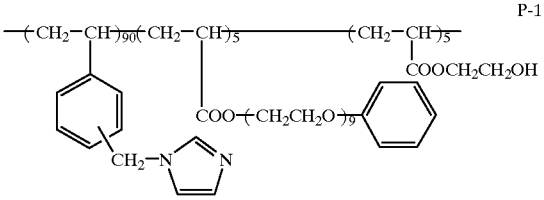

P-12

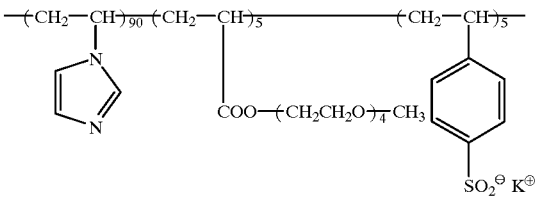

P-13

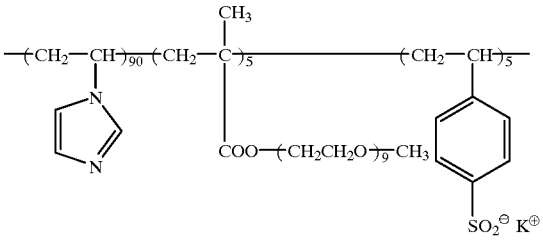

P-14

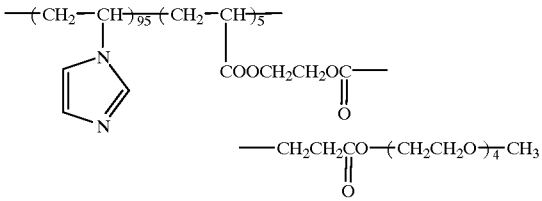

P-15

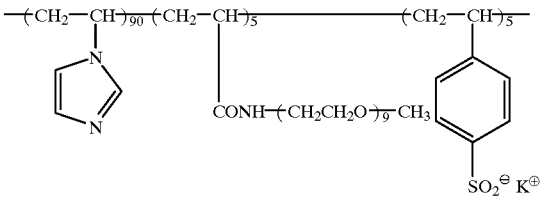

P-16

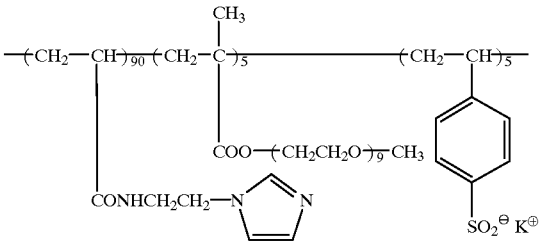

-continued

P-17

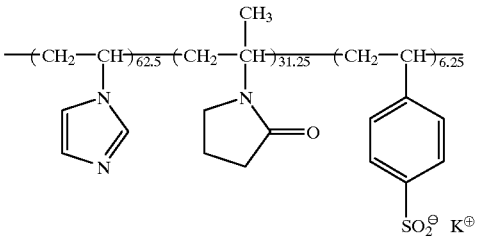

The process for the synthesis of the dye-receptive polymer comprising a monomer unit represented by the general formula (I) to be used herein is described in JP-A-62-244043. In accordance with the process, the dye-receptive polymer can be synthesized.

In the present invention, the incorporation of the dye-receptive polymer comprising a monomer unit represented by the general formula (I) in the coating layer causes the dye in the ink to be firmly received by the dye-receptive polymer, making it possible to give an image having an improved quality and a drastically improved light-fastness.

The inorganic pigment employable herein is not specifically limited and may be any suitable inorganic pigment. Examples of such an inorganic pigment include silica pigment, alumina pigment, titanium dioxide pigment, zinc oxide pigment, zirconium oxide pigment, micaceous iron oxide, white lead, lead oxide pigment, cobalt oxide pigment, strontium chromate, molybdenum-based pigment, smectite, magnesium oxide pigment, calcium oxide pigment, calcium carbonate, and mullite. These inorganic pigments may be used singly or in combination.

Preferred among these inorganic pigments are silica pigment and alumina pigment. As such a silica pigment there may be used either spherical silica or amorphous silica. Such a silica pigment may be a product of synthesis method such as dry process, wet process and aerogel process. Alternatively, the silica pigment may be a hydrophobic silica obtained by the surface treatment of silica with trimethylsilyl group or silicone. Such a silica pigment is preferably used as colloidal silica. The average particle diameter of the silica pigment to be used herein is preferably from 4 mμ to 120 mμ, more preferably from 4 mμ to 90 mμ. The silica pigment to be used herein may or may not be porous but is preferably porous. The average diameter of pores in the particulate silica pigment is preferably from 50 to 500 Å. The volume of pores in the particulate silica pigment is preferably from 0.5 to 3 cc/g.

As the alumina pigment there is preferably used either anhydrous alumina or alumina hydrate. As the anhydrous alumina there may be used any of various crystalline alumina such as α-alumina, β-alumina, γ-alumina, δ-alumina, ζ-alumina, η-alumina, θ-alumina, κ-alumina, ρ-alumina and χ-alumina. As the alumina hydrate there is preferably used either alumina monohydrate or trihydrate. Examples of the alumina monohydrate include pseudoboehmite, boehmite, and diaspore. Examples of the alumina trihydrate include gibbsite, and bayerite. Preferred among these alumina pigments is alumina hydrate. The average particle diameter of the alumina pigment to be used herein is preferably from 4 to 300 mμ, preferably from 4 to 200 mμ. The alumina pigment to be used herein may or may not be porous but is preferably porous. The average diameter of pores in the particulate alumina pigment is preferably from 50 to 500 Å. The volume of pores in the particulate alumina pigment is from 0.3 to 3 cc/g.

The process for the synthesis of alumina hydrate is not specifically limited. For example, a sol-gel process involving the addition of ammonia to an aluminum salt solution causing precipitation or a process involving hydrolyzation of alkali aluminate may be employed. The alumina hydrate may be heated and dehydrated to produce anhydrous alumina which is used herein.

In the present invention, the incorporation of such an inorganic pigment in the coating layer provides a porous coating layer that can absorb an ink at an extremely higher rate. As a result, the image thus formed has an improved quality. Further, the problem of transfer of an ink to a paper or other objects superimposed on the image can be solved.

In the present invention, a coating layer containing a dye-receptive polymer comprising a monomer unit represented by the general formula (I) described in detail above and one or more inorganic pigments is provided.

The dye-receptive polymer comprising a monomer unit represented by the general formula (I) and the inorganic pigments may be incorporated in the same coating layer or separately incorporated in two or more coating layers. In particular, it is preferred that these components be separately incorporated in two or more coating layers so that coating layers having different functions are provided.

The case where these components are incorporated in the same coating layer (hereinafter referred to as "Type A") will be further described hereinafter.

The weight ratio of dye-receptive polymer comprising a monomer unit represented by the general formula (I) to one or more inorganic pigments to be incorporated in the coating layer (dye-receptive polymer/inorganic pigment) is from 95/5 to 5/95, preferably from 90/10 to 10/90. If the weight ratio of the dye-receptive polymer comprising a monomer unit represented by the general formula (I) exceeds the above defined range, the coating layer formed by the inorganic pigment exhibits an extremely reduced pore volume that retards the absorption of an ink. The highest volume of pores in the coating layer is preferably from 0.1 to 3 cc/g. On the contrary, if the weight ratio of the dye-receptive polymer comprising a monomer unit represented by the general formula (I) falls below the above defined range, the resulting coating layer exhibits a deteriorated dye receptivity that deteriorates the image quality and light-fastness. The inorganic pigment to be used herein is not specifically limited. The inorganic pigments as mentioned above are preferably used, singly or in admixture.

The coated amount of the dye-receptive polymer comprising a monomer unit represented by the general formula (I) and the one or more inorganic pigments can be easily determined by those skilled in the art depending on the amount of ink dye to be used, the kind and composition of the dye-receptive polymer comprising a monomer unit represented by the general formula (I), etc. It is preferably from 3 to 50 g/m$^2$, most preferably from 5 to 40 g/m$^2$.

In the present invention, the coating layer comprises a binder incorporated therein as necessary. As such a binder there is preferably used a hydrophilic binder. Examples of such a hydrophilic binder are disclosed in JP-A-62-253159, pp. 26–28. In some detail, a transparent or semitransparent hydrophilic binder is preferred. Examples of such a transparent or semitransparent hydrophilic binder include natural compounds such as protein (e.g., gelatin, gelatin derivative), and polysaccharides (e.g., cellulose derivative, starch, gum arabic, dextran, pullulan), and synthetic high molecular compounds such as polyvinyl alcohol, polyvinyl pyrrolidone and polyacrylamide. Other examples of binders employable herein include high absorbing polymers disclosed in JP-A-62-245260, i.e., homopolymer of vinyl monomer having —COOM or —$SO_3$M (in which M represents a hydrogen atom or an alkali metal), copolymer of these vinyl monomers, copolymer of these vinyl monomers with other vinyl monomers (e.g., sodium methacrylate, ammonium methacrylate). Two or more of these binders may be used in combination.

The weight ratio of binder/(dye-receptive polymer+inorganic pigment) is from 0.1/99.9 to 80/20. If the ratio of the binder exceeds the above defined range, the resulting coating layer exhibits a deteriorated dye receptivity and a reduced pore volume that disadvantageously deteriorates light-fastness and ink absorption rate.

In the present invention, a dye-receptive polymer comprising a monomer unit represented by the general formula (I), one or more inorganic pigments, and optionally a binder and additives described later are dissolved or dispersed in a solvent in an arbitrary proportion. The solution or dispersion thus obtained is applied to a substrate, and then dried to obtain an image recording medium according to the present invention. As the solvent there may be used either an aqueous solvent or an organic solvent. The coating method is not specifically limited. Preferred examples of the coating means employable herein include die coater, roll coater, blade coater, bar coater, comma coater, and gravure coater. The temperature at which the coated material is dried is not specifically limited but may be such that the support cannot be damaged. Under some drying conditions, the coating layer may crack on the surface thereof. Cracking may or may not occur. The size of cracks, if any, is not restricted.

The image recording medium of the present invention thus obtained comprises a dye-receptive polymer comprising a monomer unit represented by the general formula (I) and one or more inorganic pigments incorporated in the same coating layer. Further, the coating layer thus formed is a porous layer. Thus, the image recording medium of the present invention thus obtained can absorb an ink at a high rate, gives an excellent image quality and exhibits an excellent light-fastness.

In the present invention, the combined use of a dye-receptive polymer comprising a monomer unit represented by the general formula (I) and one or more inorganic pigments makes it possible to provide an image recording medium which gives a very excellent image quality and an excellent light-fastness to an extent that cannot be expected with the single use of these components.

The case where a dye-receptive polymer comprising a monomer unit represented by the general formula (I) and one or more inorganic pigments are separately incorporated in two or more coating layers will be described hereinafter.

In this case, there are two structures.

1) The upper layer contains a dye-receptive polymer comprising a monomer unit represented by the general formula (I), and the lower layer contains one or more inorganic pigments. (This structure will be hereinafter referred to as "Type B-1".)

2) The upper layer contains one or more inorganic pigments, and the lower layer contains a dye-receptive polymer comprising a monomer unit represented by the general formula (I). (This structure will be hereinafter referred to as "Type B-2".)

In the present invention, both the foregoing Type B-1 and Type B-2 are preferably used. The layer containing a dye-receptive polymer comprising a monomer unit represented by the general formula (I) will be hereinafter referred to as "dye-receptive layer", and the layer containing one or more inorganic pigments will be hereinafter referred to as "inorganic pigment layer".

Type B-1 will be further described hereinafter. Firstly, a dye-receptive layer containing a dye-receptive polymer comprising a monomer unit represented by the general formula (I) is provided. The coated amount of the dye-receptive polymer comprising a monomer unit represented by the general formula (I) is preferably from 2 to 50 g/m$^2$, more preferably from 5 to 40 g/m$^2$. If the coated amount of the dye-receptive polymer comprising a monomer unit represented by the general formula (I) falls below the above defined range, the resulting coating layer exhibits a deteriorated dye receptivity and light-fastness. The binder which is optionally used is same as used in the foregoing Type A. The weight ratio of binder/dye-receptive polymer is preferably from 0.1/99.9 to 80/20, more preferably from 10/90 to 70/30. If the weight ratio of the binder exceeds the above defined range, the resulting coating layer exhibits a deteriorated dye receptivity and light-fastness.

The percent water swelling of the entire dye-receptive layer is preferably from not less than 100% to not more than 300%, more preferably from not less than 150% to not more than 250%. The term "percent swelling" as used herein is meant to indicate a value obtained by dividing the thickness of the dye-receptive layer swollen with dropping water by the dry thickness of the dye-receptive layer, and then multiplying the quotient by 100. The control of the swelling behavior is very important for the controlling of diffusion or spreading of ink and the prevention of damage in the printer.

An inorganic pigment layer is then provided on the dye-receptive layer. The inorganic polymer to be used herein is not specifically limited. The inorganic pigments mentioned above are preferably used. These inorganic pigments may be used singly or in admixture. The coated amount of such an inorganic pigment is preferably from 0.1 to 20 g/m$^2$, more preferably from 0.1 to 10 g/m$^2$. In the case of Type B-1, the inorganic pigment layer acts to absorb an ink rapidly from the surface of the recording medium. If the coated amount of the inorganic pigment exceeds the above defined range, the ink spreads horizontally on the recording paper, causing stain that deteriorates image quality. On the contrary, if the coated amount of the inorganic pigment falls below the above defined range, the resulting inorganic pigment layer exhibits a deteriorated ink absorption that retards the ink absorption and hence causes beading resulting in the deterioration of image quality.

The binder which is optionally used is same as used in the foregoing Type A. The weight ratio of binder/inorganic pigment is preferably from 0.1 to 99.9 to 50/50, more preferably from 2/98 to 30/70. If the weight ratio of the binder exceeds the above defined range, the resulting inorganic pigment layer has a reduced pore volume that disadvantageously reduces the ink absorption rate. The volume of pores in the inorganic pigment layer is preferably from 0.1 to 3 cc/g.

The method for the application of the foregoing dye-receptive layer and the temperature at which these layers are coated are not specifically limited. The same method as used in the foregoing Type A can be used. The various coating layers are preferably applied either successively or simultaneously.

The recording medium of Type B-1 of the present invention thus obtained comprises a porous inorganic pigment layer as an upper layer. Accordingly, this type of a recording medium can absorb an ink at a very high rate as compared with the structure comprising a dye-receptive polymer comprising a monomer unit represented by the general formula (I) and one or more inorganic pigments incorporated in the same layer. Further, this type of a recording medium comprises a dye-receptive layer containing a dye-receptive polymer comprising a monomer unit represented by the general formula (I) as a lower layer. Accordingly, it exhibits an excellent light-fastness and gives an excellent image quality.

Type B-2 will be further described hereinafter. Firstly, an inorganic pigment layer is provided on a support. The inorganic pigment to be used herein is not specifically limited. As such an inorganic pigment there is preferably used any of the foregoing inorganic pigments. These inorganic pigments may be used singly or in admixture. The coated amount of such an inorganic pigment is preferably from 5 to 70 g/m$^2$, more preferably from 7 to 50 g/m$^2$. In the case of Type B-2, the inorganic pigment layer acts to absorb an ink solvent or wetting agent rapidly from the surface of the recording medium. If the coated amount of the inorganic pigment falls below the above defined range, the resulting inorganic pigment layer exhibits a deteriorated absorptivity that retards the drying of ink. On the contrary, if the coated amount of the inorganic pigment exceeds the above defined range, curling may occur to a practical disadvantage. The binder which is optionally used is same as used in the foregoing Type A. The weight ratio of binder/inorganic pigment is preferably from 0.1/99.9 to 50/50, more preferably 2/98 to 30/70. If the weight ratio of the binder exceeds the above defined range, the resulting inorganic pigment layer exhibits a reduced pore volume that extremely retards the absorption of an ink solvent or wetting agent to disadvantage. The volume of pores in the inorganic pigment layer is preferably from 0.1 to 3 cc/g.

A dye-receptive layer containing a dye-receptive polymer comprising a monomer unit represented by the general formula (I) is then provided on the inorganic pigment layer. The coated amount of the dye-receptive polymer comprising a monomer unit represented by the general formula (I) is preferably from 0.2 to 20 g/m$^2$, more preferably from 0.5 to 10 g/m$^2$. If the coated amount of the dye-receptive polymer comprising a monomer unit represented by the general formula (I) exceeds the above defined range, the resulting dye-receptive layer has a raised thickness that retards the absorption of an ink to disadvantage. On the contrary, if the coated amount of the dye-receptive polymer comprising a monomer unit represented by the general formula (I) falls below the above defined range, the resulting dye-receptive layer exhibits a deteriorated dye receptivity that deteriorates light-fastness and image quality. The binder which is optionally used is same as used in the foregoing Type A. The weight of binder/dye-receptive polymer is preferably from 0.1/99.9 to 80/20, more preferably from 10/90 to 50/50. If the weight ratio of the binder exceeds the above defined range, the resulting dye-receptive layer exhibits a deteriorated dye receptivity that deteriorates light-fastness and image quality.

The method for the application of the foregoing dye-receptive layer and the temperature at which these layers are coated are not specifically limited. The same method as used in the foregoing Type A can be used. The various coating layers are preferably applied either successively or simultaneously.

The recording medium of Type B-2 of the present invention thus obtained comprises a dye-receptive layer containing a dye-receptive polymer comprising a monomer unit represented by the general formula (I) as an upper layer. Accordingly, this type of a recording medium gives a very excellent image density and an excellent image quality and exhibits an excellent light-fastness as compared with the structure comprising a dye-receptive polymer comprising a monomer unit represented by the general formula (I) and one or more inorganic pigments incorporated in the same layer. This type of a recording medium further comprises a porous inorganic pigment layer as a lower layer. Accordingly, it can rapidly absorb an ink solvent or wetting agent, making it possible to dry an ink rapidly.

As mentioned above, the present invention can provide an excellent image recording medium regardless of whether a dye-receptive polymer comprising a monomer unit represented by the general formula (I) and one ore more inorganic pigments are incorporated in the same coating layer or separately incorporated in different coating layers.

As necessary, the image recording medium of the present invention may comprise auxiliary layers such as protective layer, layer containing a fluorescent brightening agent for improving the white background and anticurling layer besides the foregoing coating layer containing a dye-receptive polymer comprising a monomer unit represented by the general formula (I) and one or more inorganic pigments. In particular, the provision of a protective layer and a coating layer containing a fluorescent brightening agent for improving the white background is effective.

The image recording medium of the present invention may comprise a matting agent incorporated therein. As such a matting agent there may be used a known matting agent. The matting agent is well known in the art of photography and can be defined as a solid particulate discontinuity of inorganic or organic material dispersible in a hydrophilic organic colloidal binder. Examples of inorganic matting agents include oxides (e.g., silicon dioxide, titanium oxide, magnesium oxide and aluminum oxide), salts of alkaline earth metals (e.g., sulfonates or carbonates such as barium sulfate, calcium carbonate, magnesium sulfate and calcium carbonate), silver halide grains which form an image (e.g., silver chloride and silver bromide which may contain a slight amount of iodine atom as a halogen component), and glass.

Alternatively, inorganic matting agents disclosed in West German Patent No. 2,529,321, British Patent Nos. 760,775 and 1,260,772, and U.S. Pat. Nos. 1,201, 905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245, and 4,029,504 may be used.

Examples of organic matting agents include starch, cellulose ester (e.g., cellulose acetate propionate), cellulose ether (e.g., ethyl cellulose), and synthetic resins. As such a synthetic resin there may be used a water-insoluble or hardly water-soluble synthetic polymer. For example, a polymer comprising as a monomer component alkyl (meth)acrylate, alkoxyalkyl (meth)acrylate, glycidyl (meth)acrylate, (meth) acrylamide, vinyl ester (e.g., vinyl acetate), acrylonitrile, olefin (e.g., ethylene), styrene, benzoguanamine, formaldehyde condensate, etc., singly or in combination with each other or with acrylic acid, methacrylic acid, α, β-unsaturated dicarboxylic acid, hydroxyalkyl (meth)acrylate, sulfoalkyl (meth)acrylate, styrenesulfonic acid, etc. may be used.

Alternatively, epoxy resin, nylon, polycarbonate, phenolic resin, polyvinyl carbazole, polyvinylidene chloride, etc. may be used.

Furthermore, organic matting agents disclosed in British Patent 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924, and 3,767,448, and JP-A-49-106821 and JP-A-57-14835 may be used.

Particularly preferred among these organic matting agents are polymethyl methacrylate, benzoguanamine-formaldehyde condensed polymer (benzoguanamine resin specifically represented by the following general formula, e.g., Eposter, available from NIPPON SHOKUBAI CO., LTD., existing chemical substance 7-31), polyolefin (e.g., Flowbead LE-1080, CL-2080 and HE-5023, available from Seitetsu Kagaku K.K., Chemipearl V-100, available from Mitsui Petrochemical Industries, Ltd.), polystyrene bead (available from Moritex Corp.), nylon bead (available from Moritex Corp.), AS resin bead (available from Moritex Corp.), epoxy resin bead (available from Moritex Corp.), and polycarbonate resin (available from Moritex Corp.).

As an alkali-soluble matting agent there may be used an alkali-soluble matting agent such as alkyl methacrylate/methacrylic acid copolymer disclosed in JP-A-53-7231, JP-A-58-66937 and JP-A-60-8894 or an alkali-soluble polymer containing an anionic group disclosed in JP-A-58-166341. These matting agents may be used in combination.

The recording medium according to the present invention may comprise a hardener incorporated therein. The hardener which can be incorporated in the recording medium of the present invention is not specifically limited. Known hardeners may be used. Examples of these known hardener employable herein include aldehyde-based hardeners (e.g., formaldehyde, glyoxal, glutaraldehyde), aziridine-based hardeners (as disclosed in PB Report 19,921, U.S. Pat. Nos. 2,950,197, 2,964,404, 2,983,611 and 3,271,175, JP-B-46-40898 (The term "JP-B" as used herein means an "examined Japanese patent publication"), and JP-A-50-91315), isoxazole-based hardeners (as disclosed in U.S. Pat. No. 331,609), epoxy-based hardeners (as disclosed in U.S. Pat. No. 3,047,394, West German Patent 1,035,663, British Patent 1,033,518, JP-B-48-35495), vinylsulfonic hardeners (e.g., 1,3,5-triacryloyl-hexahydro-s-triazine, bis (vinylsulfonyl)methylether, N,N'-ethylne-bis (vinylsulfonylacetamide)ethane, N,N'-trimethylene-bis (vinylsulfonylacetamide), those disclosed in PB Report 19,920, West German Patents 1,100,924, 2,337,412, 2,545,722, 2,635,518, 2,742,308 and 2,749,260, British Patent 1,251,091, Japanese Patent Application Nos. 45-54236 and 48-110996, and U.S. Pat. Nos. 3,539,644 and 3,490,911), acryloyl-based hardeners (as disclosed in Japanese Patent Application No. 48-27949, and U.S. Pat. No. 3,640,720), carbozimide-based hardeners (as disclosed in U.S. Pat. Nos. 2,938,892, 4,043,818 and 4,061,499, JP-B-46-38715, and Japanese Patent Application No. 49-15095), triazine-based hardeners (e.g., 2, 4-dichloro-6-hydroxy-s-triazine, those disclosed in West German Patents 2,410,973 and 2,553,915, U.S. Pat. No. 3,325,287, and JP-A-52-12722), N-methylol-based hardeners (e.g., dimethylolurea, methyloldimethyl hydantoin), dioxane derivatives (e.g., 2,3-dihydroxydioxane), mucohalogenic acid-based hardeners (e.g., mucochloric acid, mucophenoxychloric acid), dialdehyde starch, 1-chloro-6-hydroxytriazinylated gelatin, maleimide-based hardeners, acetylene-based hardeners, and methanesulfonic acid ester-based hardeners.

Examples of the high molecular hardeners employable herein include polymer containing an aldehyde group (e.g., acrolein copolymer) disclosed in U.S. Pat. No. 3,396,029, polymer containing a dichlorotriazine group disclosed in U.S. Pat. No. 3,362,827 and Research Disclosure No. 17,333 (1978), polymer containing an epoxy group disclosed in U.S. Pat. No. 3,623,878, polymer containing an active vinyl group or group which can become a precursor thereof disclosed in U.S. Pat. No. 4,161,407, and JP-A-54-65033 and 56-142524, and polymer containing an active ester group disclosed in JP-A-56-66841. The amount of such a high molecular hardener added is arbitrary but is preferably from about 0.1 to 30 wt-%, particularly from 0.5 to 10 wt-% of that of materials which can react with the high molecular hardener.

In the present invention, the image recording medium may comprise a bactericide or antifungal agent incorporated therein to prevent the rotting of the dispersion or coating solution of various chemicals.

As the bactericide or antifungal agent employable herein there may be used any water-soluble bactericide or antifungal agent. Specific examples of such a water-soluble bactericide or antifungal agent employable herein include thiazolylbenzimidazole-based compounds, isothiazolone-based compounds, chlorophenol-based compounds, bromophenol-based compounds, thiocyanic acid-based compounds, isothiacyanic acid-based compounds, acid azide-based compounds, diazine-based compounds, triazine-based compounds, thiourea-based compounds, alkylguanidine compounds, quaternary ammonium salts, organic tin compounds, organic zinc compounds, cyclohexylphenol-based compounds, imidazole-based compounds, benzimidazole-based compounds, sulfamide-based compounds, chlorinated isocyanuric acid, active halogen compound with sodium, chelating agents, sulfurous acid compounds, and antibiotics such as penicillin. Other examples of the bactericide or antifungal agent employable herein include germicides disclosed in K. E. West, "Water Quality Criteria", Phot. Sci. and Eng., Vol. 9, No. 6 (1965), various antifungal agents disclosed in JP-A-57-8542, JP-A-58-105145, JP-A-59-126,533, JP-A-55-111,942, and JP-A-57-157,244, and bactericides and antifungal agents disclosed in Hiroshi Horiguchi, "*Bokin Bobai no Kagaku* (Bactericidal and Antifungal Chemistry)", Sankyo Shuppan, 1982.

The image recording medium of the present invention may comprise various surface active agents for various purposes, e.g., facilitation of coating, antistatic effect, improvement of slipperiness, prevention of adhesion.

Examples of surface active agents employable herein include nonionic surface active agents such as saponin (steroid-based compound), alkylene oxide derivative (e.g., polyethylene glycol, polyethylene glycol/polypropylene glycol condensate, polyethylene glycol alkyl ether, polyethylene glycol alkylaryl ether, polyethylene glycol ester, polyethylene glycol sorbitan ester, polyalkylne glycol alkylamine, polyalkylene glycol alkylamide, polyethylene oxide adduct of silicone), glycidol derivative (e.g., polyglyceride alkenylsuccinate, alkylphenol polyglyceride) and alkyl ester (e.g., aliphatic acid ester of polyvalent alcohol); anionic surface active agents containing acidic group such as carboxyl group, sulfo group, phospho group, sulfuric acid ester group and phosphoric acid ester group (e.g., alkylcarboxylate, alkylsulfonate, alkylbenzenesulfonate, alkylnaphthalenesulfonate, alkylsulfuric acid ester, alkylphosphoric acid ester, N-acyl-N-alkyltauric acid, sulfosuccinic acid ester, phosphoalkyl polyoxyethylene alkylphenyl ether and polyoxyethylene alkyl eicosanic acid ester); amphoteric surface active agents such as amino acid, aminoalkylsulfonic acid, aminoalkylsulfuric acid ester, aminoalkylphosphoric acid ester, alkylbetaine and amine oxide; and cationic surface active agents such as alkylamine salt, aliphatic quaternary ammonium salt, aromatic quaternary ammonium salt, pyridinium, heterocyclic quaternary ammonium salt such as imidazolium, aromatic phosphonium or sulfonium salt and phosphonium or sulfonium salt containing heterocycles.

The image recording medium of the present invention may comprise a high boiling organic solvent incorporated as a plasticizer, lubricant or anticurling agent incorporated therein. Specific examples of such a high boiling organic solvent are disclosed in the above cited Research Disclosure and JP-A-62-245,253.

For the foregoing purposes, various silicone oils (all kinds of silicone oils ranging from dimethyl silicone oil to modified silicone oil obtained by introducing various organic groups into dimethyl siloxane) may be used. Useful examples of these silicone oils are various modified silicone oils, particularly carboxy-modified silicone (X-22-3710), disclosed in "Modified Silicone Oil" (technical bulletin published by Shin-Etsu Silicone Co., Ltd.), pp. 6-18B.

Other useful examples of silicone oils include those disclosed in JP-A-62-215,953 and JP-A-63-46,449.

The photographic light-sensitive material or dye-fixing element may comprise a discoloration inhibitor incorporated therein. Examples of the discoloration inhibitor employable herein include oxidation inhibitor, ultraviolet absorber, and various metallic complexes.

Examples of the oxidation inhibitor employable herein include chroman-based compounds, coumaran-based compounds, phenol-based compounds (e.g., hindered phenol), hydroquinone derivatives, hindered amine derivatives, and spiroindane-based compounds. Other useful examples of the oxidation inhibitor include those disclosed in JP-A-61-159,644.

Examples of the ultraviolet absorber employable herein include benzotriazole-based compounds (as disclosed in U.S. Pat. No. 3,533,794), 4-thiazolidone-based compounds (as disclosed in U.S. Pat. No. 3,352,681), benzophenone-based compounds (as disclosed in JP-A-46-2,784), and compounds disclosed in JP-A-54-48,535, JP-A-62-136,641, and JP-A-61-88,256. Further, an ultraviolet-absorbing polymer as disclosed in JP-A-62-260,152 is useful.

Examples of the metallic complex employable herein include compounds disclosed in U.S. Pat. Nos. 4,241,155, 4,245,018 (3rd column–36th column) and 4,254,195 (3rd column–8th column), JP-A-62-174,741, JP-A-61-88,256 (pp. 27–29), JP-A-63-199,248, JP-A-1-75,568, and JP-A-1-74,272.

Useful examples of the discoloration inhibitor are disclosed in JP-A-62-215272. The discoloration inhibitor for inhibiting the discoloration of an imagewise-patterned dye on the recording medium may be previously incorporated in the recording medium or may be incorporated in an ink or the like which is then externally supplied onto the recording medium.

The foregoing oxidation inhibitor, ultraviolet absorber and metallic complex may be used in combination.

The image recording medium of the present invention may comprise a fluorescent brightening agent incorporated therein. It is particularly preferable that the fluorescent brightening agent be incorporated in the recording medium or be incorporated in an ink or the like which is then externally supplied onto the recording medium. Examples of the fluorescent brightening agent employable herein include compounds disclosed in J. Veenkatamaran, "The Chemistry of Synthetic Dyes", Vol. V, Chap. 8, and JP-A-61-143752. Specific examples of these compounds include stilbene-based compounds, coumarin-based compounds, biphenyl-based compounds, benzoxazolyl-based compounds, naphthalimide-based compounds, pyrazoline-based compounds, and carbostyryl-based compounds. Such a fluorescent brightening agent may be used in combination with the discoloration inhibitor.

The support for the image recording medium of the present invention is not specifically limited. For example, a paper or synthetic high molecular compound (film) may be used. Specific examples of these support materials include polyethylene terephthalate film, polycarbonate film, polyvinyl chloride film, polystyrene film, polypropylene film, polyimide film, cellulose (e.g., triacetyl cellulose) film, materials comprising a pigment such as titanium oxide incorporated in these films, film process synthetic paper made of polypropylene, mixed paper made of synthetic resin pulp such as polyethylene pulp and natural pulp, Yankee paper, baryta paper, cast-coated paper, metal, cloth, and glass. These support materials may be used singly or in the form of support laminated with a synthetic high molecular compound such as polyethylene on one or both sides thereof. Further, support materials as disclosed in JP-A-62-253159 may be used.

Particularly preferred examples of the support material employable herein include a paper laminated with a polyolefin (e.g., polyethylene, polystyrene, polybutene), polyethylene terephthalate or the like on both sides thereof, and a plastic support (preferably comprising a white pigment such as titanium oxide and zinc oxide or tinting pigment such as cobalt blue, ultramarine and neodium oxide incorporated in a polyolefin).

The thickness of the polyolefin layer is not specifically limited but is preferably from 10 to 100 $\mu$m, more preferably from 15 to 50 $\mu$m, particularly from 20 to 35 $\mu$m. The surface of the polyolefin layer may be mirror-finished or regularly or irregularly roughened or may be arbitrarily shaped. In particular, the polyolefin is preferably mirror-finished on the main surface thereof. The polyolefin layer is subjected to surface activation treatment such as corona discharge treatment and flame treatment, optionally followed by the application of an undercoating layer. A coating layer of the present invention is then applied to the surface of the polyolefin layer.

The white pigment which can be incorporated in the polyolefin on the surface side is not specifically limited. Titanium oxide and zinc oxide are preferred. In particular, anatase type titanium oxide is preferred. In order to improve its dispersibility, anatase type titanium oxide is preferably used in combination with zinc oxide in an amount of not more than 50%. The amount of the white pigment to be incorporated in the polyolefin is preferably not less than 5% by weight, more preferably from 10 to 50% by weight, particularly from 15 to 30% by weight.

The tinting pigment which can be incorporated in the polyolefin on the surface side is not specifically limited but is preferably one which can withstand a coating temperature of not lower than 300° C., such as cobalt blue, ultramarine and neodium oxide. The amount of the tinting pigment to be used is from 0.1 to 3% by weight based on the weight of the white pigment. In order to attain the desired surface reflecting properties claimed herein, the kind and amount of the tinting pigment should be carefully selected. Even pigments called ultramarine have greatly different tints from manufacture to manufacture or from product number to product number. Therefore, it is preferred that various pigments be blended to attain the desired surface reflecting properties claimed herein.

If the support is a polyethylene-laminated paper containing a white pigment such as titanium oxide, the back layer is preferably designed to exert an antistatic effect and hence have a surface resistivity of not more than $10^{12}$ Ω·cm.

The image recording medium of the present invention can be applied to all printing systems involving the release and reception of a dye, such as ink jet printing, sublimation type heat transfer printing and dye diffusion transfer printing. The effect of the present invention can be greatly exerted when the image recording medium of the present invention is applied to ink jet printing.

The ink jet printing process is not quite limited. The image recording medium may be used regardless of whether the ink jet printing process is effected on continuous or on-demand basis. The head system in the ink jet printing process is not limited. The image recording medium is preferably used in all printers, including piezo process printer, babble jet process printer, thermal jet process printer and ultrasonic printer.

In recent years, a remarkable development has been made in the field of ink jet system. For example, various new processes have been proposed and put into practical use, such as process involving the jetting of a plurality of droplets of an ink having a low concentration called photoink, each droplet having a small volume, process involving the improvement of image quality with a plurality of inks having the same hue but different concentrations and process involving the use of a colorless transparent ink. The recording medium of the present invention may be preferably used in any one of these processes. The effect of improving image quality can be remarkably exerted particularly when the image recording medium of the present invention is applied to a printer having a high printing rate or a printer of the process involving the jetting of a large amount of an ink having a low concentration.

The present invention will be further described in the following examples, but the present invention should not be construed as being limited thereto.

Type A Image Recording Medium

EXAMPLE 1

A polyethylene was extruded at a temperature of 300° C. and applied to both sides of a high quality paper (density: 1.053; thickness: 152 $\mu$m) having a pulp mixing ratio LBKP/NBSP of 6/4 to prepare a support. In some detail, a mixture of a polyethylene having a density of 0.923 with surface-treated titanium as a white pigment and ultramarine (bluish and reddish) available from Daiichi Kasei K.K. as a tinting pigment was applied to the coating layer side of the paper while a high density polyethylene having a density of 0.955 was applied to the other side of the paper. The thickness of the polyethylene layer on the coating layer side of the paper was 36 $\mu$m while the thickness of the polyethylene layer on the other side of the paper was 27 $\mu$m.

A coating layer was then applied to the resin-coated support in an amount such that the dry solid content of various components reached the following values to prepare an image recording medium sample. The main purpose of the various compounds are parenthesized, but their purposes are not limited thereto.

| | |
|---|---|
| Compound P-17 (dye-receptive polymer) | 5.0 g/m$^2$ |
| Cataloid-SI80P (inorganic pigment, colloidal silica available from Shokubai Kasei Kogyo K.K.) | 25.0 g/m$^2$ |
| PVA405 (binder, polyvinyl alcohol available from KURARARY CO., LTD.) | 3.5 g/m$^2$ |
| Compound H-01 (hardener) | 0.08 g/m$^2$ |
| Compound W-01 (surface active agent) | 0.02 g/m$^2$ |

H-01

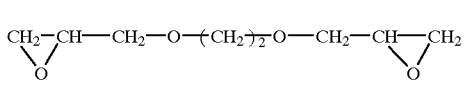

W-01

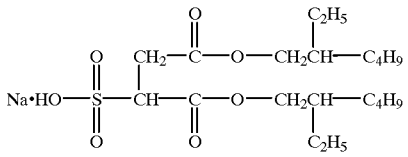

The image recording medium sample thus obtained was then evaluated in the following manner. Image quality was evaluated by image density, beading (granular density unevenness) and stain. Printing was effected by means of a Type PM700C ink jet printer (available from EPSON CO., LTD.). <Ink drying time> A yellow (Y) ink, a magenta (M) ink, a cyan (C) ink and a black (Bk) ink were solid-printed on the image recording medium sample. The image recording medium sample was then rubbed with a finger on the printed area. The time during which the inks are fixed and dried was measured.

◎: Dried in 1 sec. or less;

○: Dried in 10 sec. or less;

Δ: Dried in 1 min. or less;

x: Dried in 10 min. or less; and xx: Dried in 10 min. or more

<Image density> An M ink was solid-printed on the image recording medium sample. The image density was then measured by means of a reflection densitometer (X-Rite 310TR). <Beading> Y, M, C and Bk inks were solid-printed on the image recording medium sample. The image recording medium sample was then visually observed for granular density unevenness on the printed area.

○: No granular density unevenness observed;

Δ: Slight granular density unevenness observed; and x: Significant granular density unevenness observed <Stain> Y, M, C and Bk inks were solid-printed on the image recording medium sample. The image recording medium sample was then visually evaluated for occurrence of stain on the printed area.

○: No stain observed;

Δ: Slight stain observed; and x: Significant stain observed

<Light-fastness> An M ink was solid-printed on the image recording medium sample. The image recording medium sample was irradiated with xenon light (85,000 lux) using Atras Ci-65 weatherometer for 1 week. The image density was measured before and after the irradiation with xenon light by the foregoing reflection densitometer. For the evaluation of light-fastness of image, the percent residue of dye was determined. The percent residue of dye was calculated by the following equation:

Percent residue of dye=(Image density after irradiation with xenon light)/(Image density before irradiation with xenon light)×100 (%)

The results of these evaluation methods are set forth in Table 1.

TABLE 1

| Example No. | Ink drying time | Image density | Beading | Stain | Light-fastness (%) |
|---|---|---|---|---|---|
| Example 1 | ○ | 1.80 | ○ | ○ | 95 |
| Example 2 | ○ | 1.80 | ○ | ○ | 94 |
| Example 3 | ○ | 1.78 | ○ | ○ | 92 |
| Example 4 | ○ | 1.78 | ○ | ○ | 95 |
| Example 5 | ○ | 1.81 | ○ | ○ | 95 |
| Example 6 | ○ | 1.82 | ○ | ○ | 95 |
| Example 7 | ○ | 1.82 | ○ | ○ | 95 |
| Example 8 | ○ | 1.82 | ○ | ○ | 92 |
| Comparative Example 1 | x | 1.80 | x | Δ | 93 |
| Comparative Example 2 | ○ | 1.32 | Δ | x | 25 |

EXAMPLES 2–4

Image recording medium samples were prepared in the same manner as in Example 1 except that the following dye-receptive polymers were used instead of the dye-receptive polymer compound P-17, respectively. The image recording medium samples thus prepared were each evaluated in the same manner as in Example 1. The evaluation results are set forth in Table 1.

Example 2: P-1

Example 3: P-5

Example 4: P-10

EXAMPLES 5–7

Image recording medium samples were prepared in the same manner as in Example 1 except that the following inorganic pigments were used instead of the inorganic pigment Cataloid-SI80P, respectively. The image recording medium samples thus prepared were each evaluated in the same manner as in Example 1. The evaluation results are set forth in Table 1.

Example 5: AEROSIL200 (silica pigment available from Nihon Aerosil Co., Ltd.)

Example 3: Cataloid-SI350 (colloidal silica available from Shokubai Kasei Kogyo K.K.)

Example 4: Cataloid-AS3 (pseudoboehmite alumina hydrate pigment available from Shokubai Kasei Kogyo K.K.)

EXAMPLE 8

Cataloid-AS3 (pseudoboehmite alumina hydrate pigment available from Shokubai Kasei Kogyo K.K.) was heated and dehydrated at a temperature of 400° C. for 24 hours to obtain γ-alumina (anhydrous). An image recording medium sample was prepared in the same manner as in Example 1 except that γ-alumina (anhydrous) thus obtained was used instead of the inorganic pigment Cataloid-SI80P, respectively. The image recording medium sample thus prepared was evaluated in the same manner as in Example 1. The evaluation results are set forth in Table 1.

COMPARATIVE EXAMPLE 1

A coating layer was applied to the resin-coated support prepared in Example 1 in an amount such that the dry solid content of various components reached the following values to prepare an image recording medium sample. This sample was the same as the image recording medium sample of Example 1 except that it was free of inorganic pigment alone. The main purpose of the various compounds are parenthesized, but their purposes are not limited thereto.

| | |
|---|---|
| Compound P-17 (dye-receptive polymer) | 5.0 g/m$^2$ |
| PVA405 (polyvinyl alcohol binder available from KURARAY CO., LTD.) | 3.5 g/m$^2$ |
| Compound H-01 (hardener) | 0.08 g/m$^2$ |
| Compound W-01 (surface active agent) | 0.02 g/m$^2$ |

The image recording medium sample thus obtained was evaluated in the same manner as in Example 1. The evaluation results are set forth in Table 1.

COMPARATIVE EXAMPLE 2

A coating layer was applied to the resin-coated support prepared in Example 1 in an amount such that the dry solid content of various components reached the following values to prepare an image recording medium sample. This sample was the same as the image recording medium sample of Example 1 except that it was free of dye-receptive polymer alone. The main purpose of the various compounds are parenthesized, but their purposes are not limited thereto.

| | |
|---|---|
| Cataloid-SI80P (inorganic pigment, colloidal silica available from Shokubai Kasei Kogyo K.K.) | 25.0 g/m$^2$ |
| PVA405 (polyvinyl alcohol binder available from KURARAY CO., LTD.) | 3.5 g/m$^2$ |
| Compound H-01 (hardener) | 0.08 g/m$^2$ |
| Compound W-01 (surface active agent) | 0.02 g/m$^2$ |

The image recording medium sample thus obtained was evaluated in the same manner as in Example 1. The evaluation results are set forth in Table 1.

Type B-1 Image Recording Medium

EXAMPLE 9

A coating layer was applied to the resin-coated support prepared in Example 1 in an amount such that the dry solid content of various components reached the following values to prepare an image recording medium sample. The main purpose of the various compounds are parenthesized, but their purposes are not limited thereto.

| (Lower layer: inorganic pigment layer) | |
|---|---|
| Cataloid-SI80P (inorganic pigment colloidal silica available from Shokubai Kasei Kogyo K.K.) | 35.0 g/m$^2$ |
| PVA117 (polyvinyl alcohol binder available from KURARAY CO., LTD.) | 3.5 g/m$^2$ |

| (Upper layer: dye-receptive layer) | |
|---|---|
| Compound P-17 (dye-receptive polymer) | 1.4 g/m$^2$ |
| PVA405 (polyvinyl alcohol binder available from KURARAY CO., LTD.) | 0.7 g/m$^2$ |
| Compound H-01 (hardener) | 0.02 g/m$^2$ |
| Compound W-01 (surface active agent) | 0.02 g/m$^2$ |

The image recording medium sample thus obtained was evaluated in the same manner as in Example 1. The evaluation results are set forth in Table 1.

TABLE 2

| Example No. | Ink drying time | Image density | Beading | Stain | Light-fastness (%) |
|---|---|---|---|---|---|
| Example 9 | ○ | 1.91 | ○ | ○ | 96 |
| Example 10 | ○ | 1.88 | ○ | ○ | 95 |
| Example 11 | ○ | 1.88 | ○ | ○ | 96 |
| Example 12 | ○ | 1.88 | ○ | ○ | 95 |
| Example 13 | ○ | 1.90 | ○ | ○ | 95 |
| Example 14 | ○ | 1.89 | ○ | ○ | 95 |
| Example 15 | ○ | 1.88 | ○ | ○ | 97 |
| Example 16 | ○ | 1.87 | ○ | ○ | 96 |
| Comparative Example 3 | Δ | 1.42 | x | Δ | 32 |

EXAMPLE 10–12

Image recording medium samples were prepared in the same manner as in Example 9 except that the following dye-receptive polymers were used instead of the dye-receptive polymer compound P-17, respectively. The image recording medium samples thus prepared were each evaluated in the same manner as in Example 9. The evaluation results are set forth in Table 2.

Example 10: P-1

Example 11: P-5

Example 12: P-10

EXAMPLES 13–16

Image recording medium samples were prepared in the same manner as in Example 9 except that the following inorganic pigments were used instead of the inorganic pigment Cataloid-SI80P, respectively. The image recording medium samples thus prepared were each evaluated in the same manner as in Example 9. The evaluation results are set forth in Table 2.

Example 13: AEROSIL200 (silica pigment available from Nihon Aerosil Co., Ltd.)

Example 14: Cataloid-SI350 (colloidal silica available from Shokubai Kasei Kogyo K.K.)

Example 16: γ-Alumina (anhydrous) synthesized in Example 8

COMPARATIVE EXAMPLE 3

An image recording medium sample was prepared in the same manner as in Example 9 except that a polyvinyl pyrrolidone was used instead of the dye-receptive polymer compound P-17. The image recording medium sample thus prepared was evaluated in the same manner as in Example 9. The evaluation results are set forth in Table 2.

Type B-2 Image Recording Medium

EXAMPLE 17

A coating layer was applied to the resin-coated support prepared in Example 1 in an amount such that the dry solid content of various components reached the following values to prepare an image recording medium sample. The main purpose of the various compounds are parenthesized, but their purposes are not limited thereto.

| (Lower layer: dye-receptive layer) | |
|---|---|
| Compound P-17 (dye-receptive polymer) | 9.2 g/m$^2$ |
| PVA405 (polyvinyl alcohol binder available from KURARAY CO., LTD.) | 5.6 g/m$^2$ |
| Compound H-01 (hardener) | 0.06 g/m$^2$ |
| Compound W-01 (surface active agent) | 0.02 g/m$^2$ |

| Upper layer: inorganic pigment layer) | |
|---|---|
| Cataloid-SI80P (inorganic pigment, colloidal silica available from Shokubai Kasei Kogyo K.K.) | 3.0 g/m$^2$ |
| PVA117 (polyvinyl alcohol binder available from KURARAY CO., LTD.) | 0.3 g/m$^2$ |

The image recording medium sample thus obtained was evaluated in the same manner as in Example 1. The evaluation results are set forth in Table 3.

TABLE 3

| Example No. | Ink drying time | Image density | Beading | Stain | Light-fastness (%) |
|---|---|---|---|---|---|
| Example 17 | ⊙ | 1.80 | ○ | ○ | 95 |
| Example 18 | ⊙ | 1.80 | ○ | ○ | 92 |
| Example 19 | ⊙ | 1.80 | ○ | ○ | 93 |
| Example 20 | ⊙ | 1.78 | ○ | ○ | 94 |
| Example 21 | ⊙ | 1.80 | ○ | ○ | 92 |
| Example 22 | ⊙ | 1.81 | ○ | ○ | 93 |
| Example 23 | ⊙ | 1.80 | ○ | ○ | 92 |
| Example 24 | ⊙ | 1.80 | ○ | ○ | 92 |
| Comparative Example 4 | ○ | 1.42 | x | Δ | 28 |

EXAMPLE 18–20

Image recording medium samples were prepared in the same manner as in Example 17 except that the following dye-receptive polymers were used instead of the dye-receptive polymer compound P-17, respectively. The image recording medium samples thus prepared were each evaluated in the same manner as in Example 17. The evaluation results are set forth in Table 23

Example 18: P-1

Example 19: P-5

Example 20: P-10

EXAMPLES 21–24

Image recording medium samples were prepared in the same manner as in Example 17 except that the following inorganic pigments were used instead of the inorganic pigment Cataloid-SI80P, respectively. The image recording medium samples thus prepared were each evaluated in the same manner as in Example 1. The evaluation results are set forth in Table 3.

Example 21: AEROSIL200 (silica pigment available from Nihon Aerosil Co., Ltd.)

Example 22: Cataloid-SI350 (colloidal silica available from Shokubai Kasei Kogyo K.K.)

Example 23: Cataloid-AS3 ((pseudoboehmite alumina hydrate pigment available from Shokubai Kasei Kogyo K.K.)

Example 24: γ-Alumina (anhydrous) synthesized in Example 8

COMPARATIVE EXAMPLE 4

An image recording medium sample was prepared in the same manner as in Example 17 except that a polyvinyl pyrrolidone was used instead of the dye-receptive polymer compound P-17. The image recording medium sample thus prepared was evaluated in the same manner as in Example 1. The evaluation results are set forth in Table 3.

As mentioned above, the image recording medium of the present invention can dry an ink at a high rate, gives an excellent image quality and exhibits an excellent light-fastness.

While the invention has been described in detail and with reference to specific embodiments thereof, it will be apparent to one skilled in the art that various changes and modifications can be made therein without departing from the spirit and scope thereof.

What is claimed is:

1. An ink jet image recording medium comprising at least one porous coating layer provided on a support, wherein said at least one porous coating layer comprises a dye-receptive polymer comprising a monomer unit represented by the formula (I)

(I)

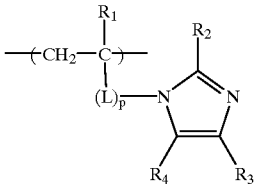

wherein $R_1$, $R_2$, $R_3$ and $R_4$ each independently represent a hydrogen atom or an alkyl group which may be straight chain or branched; L represents a divalent connecting group and p is 0 or 1;

and one or more alumina pigments or silica pigments wherein the average particle diameter of said alumina pigments is 4 to 300 nm and the average particle diameter of said silica pigments is 4 to 120 nm.

2. The ink jet recording medium according to claim 1, comprising at least one alumina pigment.

3. The ink jet recording medium according to claim 2, wherein said alumina pigment is an anhydrous alumina pigment or alumina hydrate.

4. The ink jet recording medium according to claim 1, wherein said alumina pigment is an anhydrous alumina pigment or alumina hydrate.

5. The ink jet recording medium according to claim 1, wherein said at least one porous coating layer comprises two or more layers, an upper layer containing a dye-receptive polymer comprising a monomer of the formula (I) and a lower containing one or more alumina or silica pigments.

6. The ink jet recording medium according to claim 1, wherein said at least one porous coating layer comprises two or more layers, an upper layer containing one or more alumina or silica pigments and a lower layer containing a dye-receptive polymer comprising a monomer unit represented by the formula (I).

7. The ink jet recording medium according to claim 6, comprising at least two porous coating layers provided on a support, wherein at least one porous coating layer is on the surface of said ink jet recording medium and comprises an alumina pigment or a silica pigment and wherein at least one porous coating layer is below and adjacent to the surface layer and comprises a dye-receptive polymer comprising a monomer unit represented by the formula (I).

8. The ink jet recording medium according to claim 1, wherein the volume of pores in the alumina pigment particles is 0.3 to 3 cc/g and the volume of pores in the silica pigment particles is 0.5 to 3 cc/g.

9. The ink jet recording medium according to claim 8, comprising at least two porous coating layers provided on a support, wherein at least one porous coating layer is on the surface of said ink jet recording medium and comprises an alumina pigment or a silica pigment and wherein at least one porous coating layer is below and adjacent to the surface layer and comprises a dye-receptive polymer comprising a monomer unit represented by the formula (I).

10. An ink jet image recording medium according to claim 1, comprising at least two porous coating layers provided on a support, wherein at least one porous coating layer is on the surface of said ink jet recording medium and comprises an alumina pigment or a silica pigment and wherein at least one porous coating layer is below and adjacent to the surface layer and comprises a dye-receptive polymer comprising a monomer unit represented by the formula (I).

11. An ink jet image recording medium comprising at least one porous coating layer provided on a support, wherein said at least one porous coating layer comprises a dye-receptive polymer comprising a monomer unit represented by the formula (I)

(I)

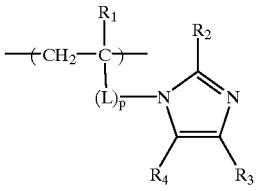

wherein $R_1$, $R_2$, $R_3$ and $R_4$ each independently represent a hydrogen atom or an alkyl group which may be straight chain or branched; L represents a divalent connecting group and p is 0 or 1;

and one or more inorganic pigments, wherein at least one of said inorganic pigments is an anhydrous alumina pigment or alumina hydrate.

12. The ink jet recording medium according to claim 4, wherein the volume of pores in the anhydrous alumina pigment or alumina hydrate particles is 0.3 to 3 cc/g.

* * * * *